US008500242B2

(12) United States Patent
Anderson et al.

(10) Patent No.: US 8,500,242 B2
(45) Date of Patent: Aug. 6, 2013

(54) MICRO-FLUID EJECTION HEAD

(75) Inventors: Frank Anderson, Sadieville, KY (US); Jiandong Fang, Lexington, KY (US); Jeanne Marie Saldanha Singh, Lexington, KY (US); Mike Dixon, Richmond, KY (US); Bryan McKinley, Lexington, KY (US); Samuel Sexton, Lawrenceburg, KY (US)

(73) Assignee: Funai Electric Co., Ltd. (JP)

( * ) Notice: Subject to any disclaimer, the term of this patent is extended or adjusted under 35 U.S.C. 154(b) by 148 days.

(21) Appl. No.: 12/974,725

(22) Filed: Dec. 21, 2010

(65) Prior Publication Data

US 2012/0154486 A1 Jun. 21, 2012

(51) Int. Cl.
*B41J 2/145* (2006.01)

(52) U.S. Cl.
USPC ..... 347/40; 347/50

(58) Field of Classification Search
USPC ..... 347/9, 12, 14, 15, 19, 20, 40–43, 347/47–50, 57–59, 71
See application file for complete search history.

(56) References Cited

U.S. PATENT DOCUMENTS 7,399,053 B2 * 7/2008 Silverbrook et al. ..... 347/20
7,494,889 B2 * 2/2009 Lee ..... 438/381

* cited by examiner

*Primary Examiner* — Thinh Nguyen
(74) *Attorney, Agent, or Firm* — Amster, Rothstein & Ebenstein LLP

(57) ABSTRACT

A micro-fluid ejection head for a printer is disclosed. The micro-fluid ejection head comprises a plurality of printhead modules. Each of the plurality of printhead modules comprises an ejection chip for ejecting fluid. The micro-fluid ejection head further comprises a support frame to mount the plurality of printhead modules for creating a lengthy array of the plurality of printhead modules. The support frame is electrically coupled with the plurality of printhead modules for allowing the plurality of printhead modules to receive data and electrical power.

9 Claims, 5 Drawing Sheets

MICRO-FLUID EJECTION HEAD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure generally relates to a printer, and more specifically, to a micro-fluid ejection head for a printer.

2. Description of the Related Art

Recent developments in the technological field of printers have led to modular approaches to printhead construction in contrast to earlier monolithic approaches. Specifically, in case of monolithic approach, power distribution and serial data input/output for ejection chips of the printhead is handled through a single wiring element, such as a printed circuit board (PCB). The wiring element may be further connected to a single flex cable adapted to provide the electrical power and serial data to the ejection chips. In such design, a long and precise base (to mount the ejection chips) is required, which is difficult to manufacture. Additionally, a major concern with such type of design is compound yield loss. Specifically, subassemblies of ejection chips cannot be verified electrically or fluidically until the printhead is fully assembled. Therefore, any failure of the ejection chip and/or electrical or fluidic interconnections may result in loss of the entire printhead. However, in case of modular approach, the printhead may include a plurality of printhead modules, and each printhead module may include at least one ejection chip and a base for at least one ejection chip. In such design fluidic and electrical interconnects for each printhead module may be fully tested before assembly into larger arrays of modules. Thereafter, the printhead modules are precisely mounted on a support frame to create a desired swath width, i.e. a lengthy array of the printhead modules, adapted to cover a width of a media sheet to be printed. Further, in such design, serial data and/or electrical power to each printhead module is provided through a separate flex cable, individually attached to each printhead module.

A need of separate flex cables, individually attached to each printhead module may require significant number and pitch of traces on the flex cables that deliver serial data and/or electrical power to each printhead module. Further, a separate flex cable for each printhead module may not provide good signal isolation and signal integrity. For example, a flex cable may have an issue of separating (properly spacing apart) power and ground, which may cause poor signal isolation and signal integrity.

Accordingly, there is a need of a printhead for a printer that overcomes the drawbacks inherent in the prior art.

SUMMARY OF THE DISCLOSURE

In view of the foregoing disadvantages inherent in the prior art, the general purpose of the present disclosure is to provide a micro-fluid ejection head for a printer, to include all the advantages of the prior art, and to overcome the drawbacks inherent therein.

In one aspect, the present disclosure provides a micro-fluid ejection head. The micro-fluid ejection head comprises a plurality of printhead modules. Each of the plurality of printhead modules comprises an ejection chip for ejecting fluid. The micro-fluid ejection head further comprises a support frame to mount the plurality of printhead modules for creating a lengthy array of the plurality of printhead modules. The support frame is electrically coupled with the plurality of printhead modules for allowing the plurality of printhead modules to receive data and electrical power.

In another aspect, the present disclosure provides a micro-fluid ejection head. The micro-fluid ejection head comprises a plurality of printhead modules. Each of the plurality of printhead modules comprises an ejection chip for ejecting fluid. The micro-fluid ejection head further comprises a support PCB to mount the plurality of printhead modules for creating a lengthy array of the plurality of printhead modules. The micro-fluid ejection head also comprises a support frame to mount the support PCB. The support PCB is electrically coupled with the plurality of printhead modules for allowing the plurality of printhead modules to receive data and electrical power.

In yet another aspect, the present disclosure provides a micro-fluid ejection head. The micro-fluid ejection head comprises a plurality of printhead modules. Each of the plurality of printhead modules comprises an ejection chip for ejecting fluid and a module base to mount the ejection chip. The module base also provides fluidic interface between the ejection chip and a fluid source. The micro-fluid ejection head further comprises a support frame to mount the module base of the plurality of printhead modules for creating a lengthy array of the plurality of printhead modules. The support frame is electrically coupled with the module base of the plurality of printhead modules for allowing the plurality of printhead modules to receive data and electrical power.

BRIEF DESCRIPTION OF THE DRAWINGS

The above-mentioned and other features and advantages of this disclosure, and the manner of attaining them, will become more apparent and the disclosure will be better understood by referencing the following description of embodiments of the disclosure taken in conjunction with the accompanying drawings, wherein.

DETAILED DESCRIPTION

Figure 1:
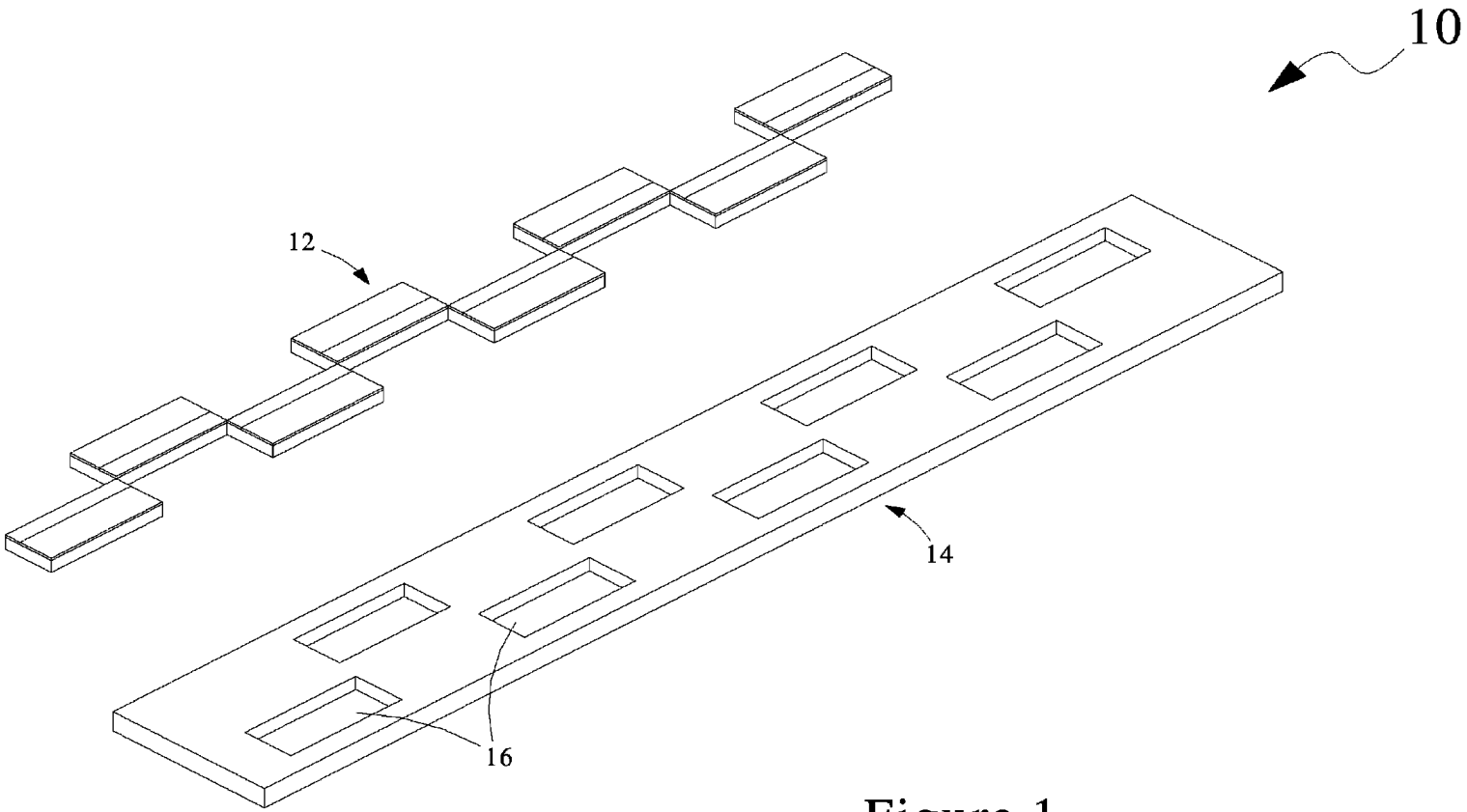
FIG. 1 is a schematic view of a micro-fluid ejection head, according to an exemplary embodiment of the present disclosure.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. Unless limited otherwise, the terms "coupled," and variations thereof herein are used broadly and encompass direct and indirect couplings. Furthermore, the use of "coupled" and variations thereof herein does not denote a limitation to the arrangement of two components.

The present disclosure provides micro-fluid ejection heads for a printer. The micro-fluid ejection heads of the present disclosure include electrically functional components, such as a printed circuit board (PCB), for receiving serial data and/or electrical power. Further, the micro-fluid ejection heads of the present disclosure is adapted to provide better signal isolation and signal integrity for the serial data and/or electrical power.

A micro-fluid ejection head of the present disclosure includes a plurality of printhead modules. Each of the plurality of printhead modules includes an ejection chip for ejecting fluid. The micro-fluid ejection head further includes a support frame to mount the plurality of printhead modules for creating a lengthy array of the plurality of printhead modules. The support frame is electrically coupled with the plurality of printhead modules for allowing the plurality of printhead modules to receive data and electrical power.

Another micro-fluid ejection head of the present disclosure includes a plurality of printhead modules. Each of the plurality of printhead modules includes an ejection chip for ejecting fluid. The micro-fluid ejection head further includes a support PCB to mount the plurality of printhead modules for creating a lengthy array of the plurality of printhead modules. The micro-fluid ejection head also include a support frame to mount the support PCB. The support PCB is electrically coupled with the plurality of printhead modules for allowing the plurality of printhead modules to receive data and electrical power.

Yet another micro-fluid ejection head of the present disclosure includes a plurality of printhead modules. Each of the plurality of printhead modules includes an ejection chip for ejecting fluid and a module base to mount the ejection chip. The module base also provides fluidic interface between the ejection chip and a fluid source. The micro-fluid ejection head further includes a support frame to mount the module base of the plurality of printhead modules for creating a lengthy array of the plurality of printhead modules. The support frame is electrically coupled with the module base of the plurality of printhead modules for allowing the plurality of printhead modules to receive data and electrical power.

The micro-fluid ejection heads of the present disclosure is explained in detail in conjunction with FIGS. 1-6.

Referring now to FIG. 1, a schematic view of a micro-fluid ejection head 10 is depicted, according to an exemplary embodiment of the present disclosure. The micro-fluid ejection head 10 includes a plurality of printhead modules 12. In the present embodiment, for the purpose of illustration the plurality of printhead modules 12 is shown with eight printhead modules. However, in actual, the number of the printhead modules 12 may vary based on a width of a media sheet to be covered (printed) by the micro-fluid ejection head 10 and the length of the chips on the individual modules. The micro-fluid ejection head 10 further comprises a support frame 14 adapted to be mounted with the plurality of printhead modules 12.

Figure 2:
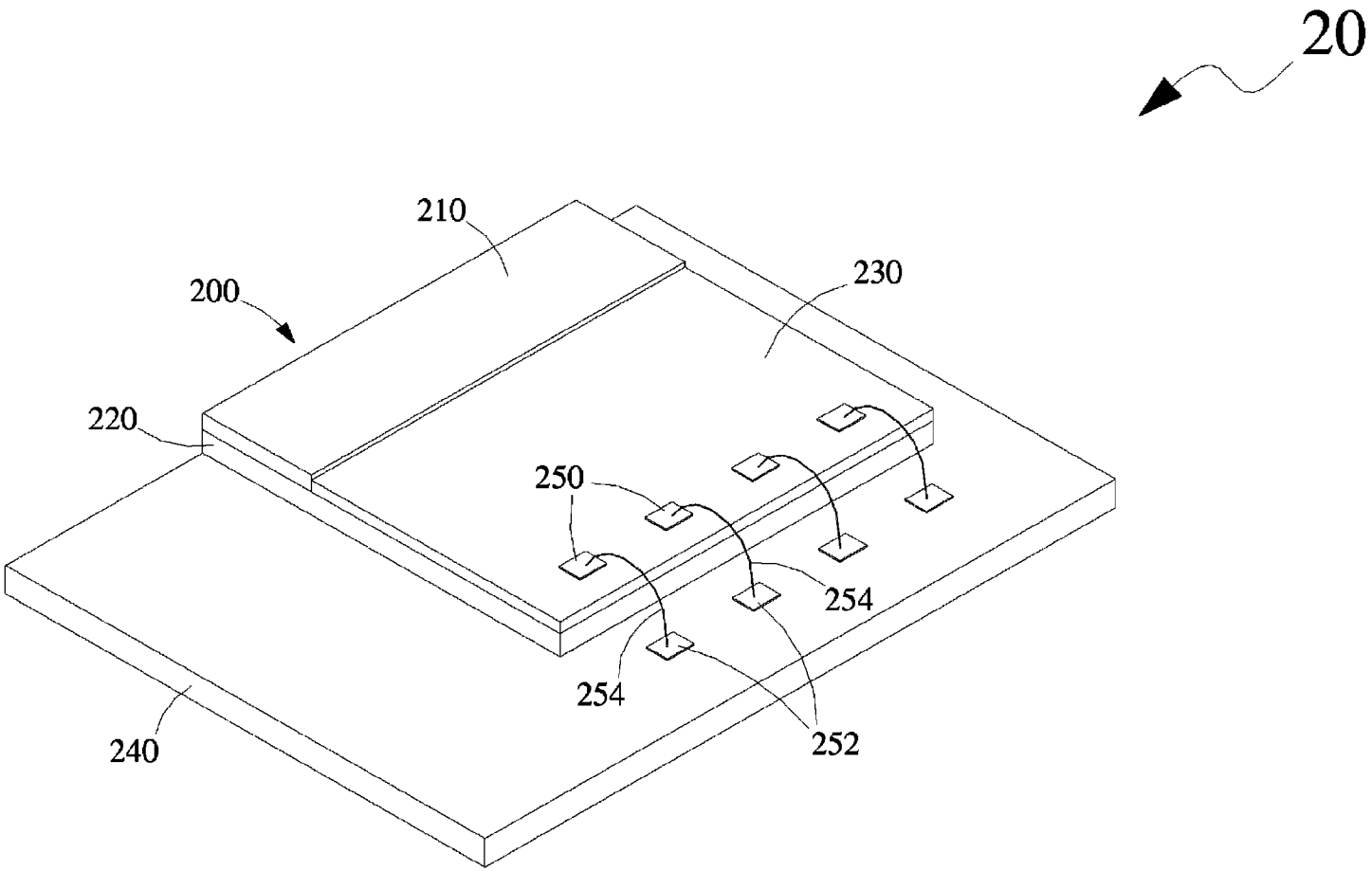
FIGS. 2-5 are schematic views of a portion of the micro-fluid ejection heads, according to various embodiments of the present disclosure.

Referring now to FIG. 2, a schematic view of a portion of a micro-fluid ejection head 20 is depicted, according to an exemplary embodiment of the present disclosure. The micro-fluid ejection head 20 comprises a plurality of printhead modules, such as a printhead module 200. It is to be understood that for the purpose of clarity only single printhead module 200 is shown in the FIG. 2. Each of the plurality of printhead modules includes an ejection chip. For example, the printhead module 200 includes an ejection chip 210. The ejection chip 210 may include a pair of thin layers of ports (not shown) sandwiching a plurality fluid channels (not shown) therebetween. The ejection chip 210 also includes a plurality of fluid firing elements (not shown), such as resistors, adapted to fire fluid through a top layer of ports covering the plurality fluid channels.

The printhead module 200 also includes a module base 220 adapted to carry the ejection chip 210 thereon. In the present embodiment, the ejection chip 210 is mounted on the module base 220 with the help of a thermally curable adhesive. For example, a thin layer of thermally curable adhesive, such as epoxides, acrylics, or bimaleimides may be disposed between the ejection chip 210 and the module base 220, and thereafter the adhesive layer is thermally cured for attaching the ejection chip 210 with the module base 220.

The module base 220 is adapted to be fluidically coupled with the ejection chip 210. Specifically, the module base 220 may include a plurality of ports confirming to ports of a bottom layer of the ejection chip 210. In such instances, it is to be understood that, the thermally curable adhesive may be dispensed in an amount and pattern such that adhesive layer facilitates fluidical coupling between the ejection chip 210 and the module base 220, without any blockage which may be caused by the adhesive layer.

In the present embodiment, the module base 220 may be made of a moldable non-conducting material. For example, the module base 220 may be made of one of ceramic, plastic and glass. Additionally, the module base 220 may be made of a low conducting metal covered with a layer of insulating material. Therefore, the module base 220 of the present disclosure is adapted to provide a mechanical support and a fluidic interface to the ejection chip 210.

The printhead module 200 also includes a module PCB (printed circuit board) 230 adapted to be mounted on the module base 220. Specifically, the module PCB 230 is mounted on the module base 220 and positioned adjacent to the ejection chip 210, as shown in FIG. 2. The module PCB 230 is electrically coupled with the ejection chip 210 by wire bonding (not shown). Therefore, the module PCB 230 is adapted to provide electrical power and serial data to the ejection chip 210. Based on the electrical power and serial data, some of the fluid firing elements of the plurality of fluid firing elements of the ejection chip 210 may be triggered for firing fluid, to be received in a media sheet for being printed, which will be explained in greater detail herein later.

As shown in FIG. 2, the micro-fluid ejection head 20 also includes a support frame 240. The support frame 240 is adapted to mount the plurality of printhead modules, such as the printhead module 200, thereon. Further, the plurality of printhead modules, such as the printhead module 200, is mounted on the support frame 240 for configuring a lengthy array of the plurality of printhead modules, such as the plurality of printhead modules 112 (shown in FIG. 1). The term "lengthy array" used herein refers to various possible arrangements of the plurality of printhead modules, such as the printhead module 200, on the support frame 240 to create a desired swath width, adapted to cover a width of a media sheet to be printed. For example, the plurality of printhead modules may be longitudinally mounted on the support frame 240 for creating the desired swath width, which is adapted to cover the width of the media sheet to be printed and/or laterally (side by side) mounted to provide additional vias for additional colors or redundancy.

In the present embodiment, the support frame 240 includes a plurality of cutouts (not shown), such as cutouts 16 carried by the support frame 14. The cutouts of the support frame 240 are adapted to partially receive module bases of the plurality of printhead modules. For example, the module base 220 may be partially received by a cutout, thereafter the module base 220 may be attached with the support frame 240 (around the cutout) using an adhesive. It is to be understood that the cutout may be configured to have a shape adapted to partially receive the module base 220. In the present embodiment, the module base 220 may be attached with the support frame 240 initially with tack and hold adhesive to fixture the module base 220 in place on the support frame 240, followed by a more structural adhesive. Specifically, the tack and hold adhesive is a radiation—UV curable acrylate adhesive while the structural adhesive is a two part room temperature cure epoxy. These two adhesives may be used for attaching the module base 220 with the support frame 240.

The cutouts of the support frame 240 further facilitate the fluidic interface between the ejection chip 210 and a fluid source. The term "fluid source" used herein refers to a fluid tank adapted to store a fluid, such as ink, therein. In the present embodiment, the module base 220 of the printhead module 200 may be fluidically attached with the fluid source with the help components, such as tubing, gaskets and adhesive seals. For example, the module base 220 is accessed through the cutout of the support frame 240 for allowing components, such as tubing, a gasket or an adhesive seal, to fluidically couple the module base 220 with the fluid source.

The support frame 240 of the present disclosure is an electrically functional component adapted to be electrically coupled with the plurality of printhead modules, such as the printhead module 200. In the present embodiment, the support frame 240 is a printed circuit board (PCB). Specifically, the support frame 240 includes a plurality of conductive layers (not shown) interspaced with a plurality of non-conductive layers (not shown). Further, the plurality of conducting layers may be composed of at least one of carbon fiber and copper, and the plurality of non-conductive layers may be composed of a prepreg material. Specifically, the conductive layers of carbon fiber may provide ground plane, whereas the conductive layers of copper may facilitate in passing electrical power and serial data. For example, the support frame 240 may be a STABLCOR® PCB; particularly, the support frame 240 may be a laminate construct having a plurality of conducting layers (wiring layer) made of carbon fiber and copper, interspaced by the non-conductive layers made of prepreg material. Alternatively, the support frame 240 may be a FR4 PCB, particularly, the support frame 240 may include a plurality of conducting layers (wiring layer) made of copper, interspaced with the non-conductive layers made of prepreg material.

As explained herein, the support frame 240 is electrically coupled with the plurality of printhead modules. Specifically, as shown in FIG. 2, the support frame 240 is electrically coupled with the module PCB 230 of the printhead module 200. In the present embodiment, the module PCB 230 is electrically coupled with the support frame 240 by wire bonding. Specifically, as shown in FIG. 2, conductor pads 250 of the module PCB 230 may be electrically coupled with conductor pads 252 of the support frame 240 with help of conductor wires 254. It is to be understood that the plurality of printhead modules, such as the printhead module 200 may be electrically and fluidically tested, prior to electrically and mechanically coupling with the support frame 240. Specifically, the conductor pads 250 of the module PCB 230 may be used for electrically and fluidically testing the printhead module 200.

Once the plurality of printhead modules, such as the printhead module 200, is electrically coupled with the support frame 240 the conductor wires, such as the conductor wires 254, may be encapsulated for insulation and protection from corrosive inks/printed materials. For example, the encapsulation of the conductor wires may be performed with help of a thermally curable adhesive, such as epoxides, acrylics, and urethanes or UV curable adhesives. Further, the thermally curable adhesive may be one of a single-part or two-part thermally curable adhesive, or a room temperature curable two part adhesive or UV curable adhesive may be used to avoid the stress development due to thermal expansion mismatches between module and support frame materials. Moreover, the encapsulation of the conductor wires 254 may be performed by a dam and fill method.

In use, the ejection chip 210 is adapted to receive the electrical power and serial data through the support frame 240. Specifically, the support frame 240 is connected to power and ground bus structures and serial data routing for receiving a specific serial data and the electrical power. Further, the conductor wires, such as the conductor wires 254, provide interconnections, such as serial data input/output and power/ground connections between the module PCB 230 and the support frame 240. Therefore, based on the specific serial data and electrical power, some of the fluid firing elements of the plurality of fluid firing elements of the ejection chip 210 may be triggered for firing fluid, to be received on a media sheet for being printed.

The use of support frame 240 as an electrically functional component provides a large conductor cross sectional area which facilitate in handling high currents with minimal voltage drops. Further, the electrically functional support frame 240 provides inherent distributed capacitance from the power and ground planes. This helps in minimizing EMC (electromagnetic compatibility) concern, and thereby improves signal integrity. Moreover, the electrically functional support frame 240 provides a possibility of mounting physical electrical components, such as capacitors, to provide local decoupling and fast response current sources, thereby maximizing performance of the micro-fluid ejection head 20.

In addition to electrical functionality, the support frame 240 also enhances mechanical and thermal properties of the micro-fluid ejection head 20. For example, use of STABLCOR® PCB as the support frame 240 provides a stiffer frame for a given thickness as compared against standard FR4 PCBs. Therefore, the support frame 240 is less likely to flex in response to mounting forces when plurality of printhead modules, such as the printhead module 200, is mounted on the support frame 240. Further, the concern of fracture during shipping/handling may be reduced with the use of STABLCOR® PCB as the support frame 240 versus some more fragile materials like ceramics. Moreover, as STABLCOR® PCB has a low CTE (coefficient of thermal expansion) and high Tg (Glass Transition temperature), the support frame 240 may be conveniently mounted with the plurality of printhead modules, such as the printhead module 200, by a thermally curable adhesive. Specifically, low CTE and high Tg of the STABLCOR® PCB enables the support frame 240 to withstand thermal cures with minimal deformation when the plurality of printhead modules, such as the printhead module 200, is attached with the support frame 240, and when wire bonding (the conductor wire 254) are encapsulated with the thermally curable adhesives.

Figure 3:
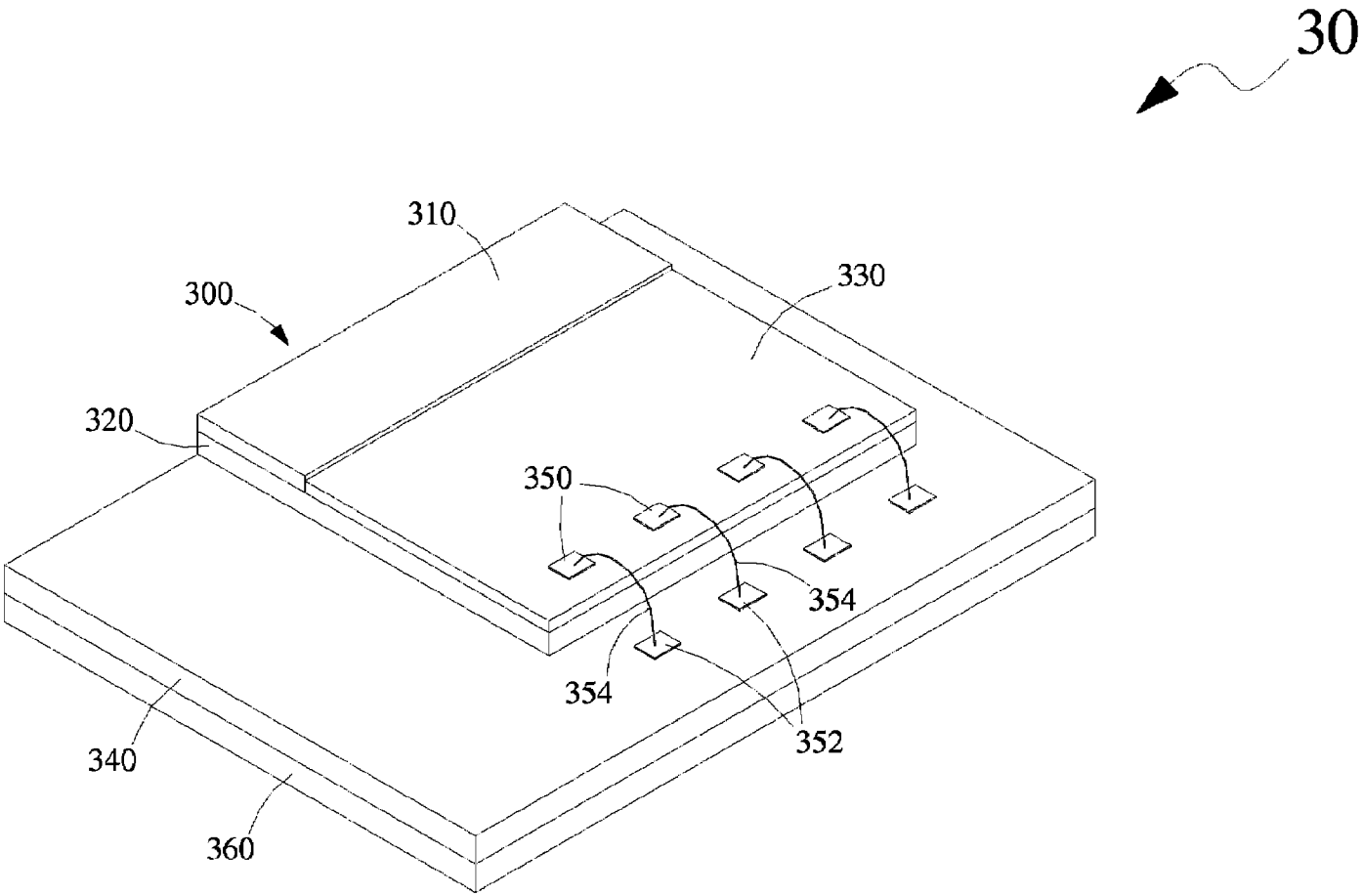

Referring now to FIG. 3, a schematic view of a portion of a micro-fluid ejection head 30 is depicted, according to another embodiment of the present disclosure. The micro-fluid ejection head 30 comprises a plurality of printhead modules, such as a printhead module 300. The plurality of printhead modules, such as the printhead module 300, of the micro-fluid ejection head 30 is configurationally and functionally similar to the plurality of printhead modules, such as the printhead module 200, of the micro-fluid ejection head 20. For example, the printhead module 300 includes an ejection chip 310, a module base 320 and a module PCB 330, which is configurationally and functionally similar to the ejection chip 210, the module base 220 and the module PCB 230, respectively, of the printhead module 300. Accordingly, the description of the plurality of printhead modules, such as the printhead module 300, of the micro-fluid ejection head 30 is avoided for the sake of brevity.

The micro-fluid ejection head 30 of the present disclosure also includes a support PCB 340. The support PCB 340 is adapted to mount the plurality of printhead modules, such as the printhead module 300, thereon. The plurality of printhead modules is mounted on the support PCB 340 for configuring a lengthy array of the plurality of printhead modules, as explained above in conjunction with FIG. 2.

In the present embodiment, the support PCB 340 includes a plurality of cutouts (not shown), such as cutouts 16 (shown in FIG. 1) carried by the support frame 14. The cutouts of the support PCB 340 are adapted to receive module bases of the plurality of printhead modules. For example, the module base 320 may be partially received by a cutout, thereafter the module base 320 may be attached with the support PCB 340 (around the cutout) using an adhesive. In the present embodiment, the module base 320 may be attached with the support PCB 340 initially with tack and hold adhesive to fixture the module base 320 in place on the support PCB 340, followed by a more structural adhesive. Specifically, the tack and hold adhesive is a radiation—UV curable acrylate adhesive while the structural adhesive is a two part room temperature cure epoxy. These 2 adhesives may be used for attaching the module base 320 with the support PCB 340.

The support PCB 340 of the present disclosure is an electrically functional component adapted to be electrically coupled with the plurality of printhead modules, such as the printhead module 300. In the present embodiment, the support PCB 340 includes a plurality of conductive layers (not shown) interspaced with a plurality of non-conductive layers (not shown). Further, the plurality of conducting layers may be composed of at least one of carbon fiber and copper, and the plurality of non-conductive layers may be composed of a prepreg material. Specifically, the conductive layers of carbon fiber may provide ground plane, whereas the conductive layers of copper may facilitate in passing electrical power and serial data. For example, the support PCB 340 may be a STABLCOR® PCB; particularly, the support PCB 340 may be a laminate construct having a plurality of conducting layers, made of carbon fiber and copper, and interspaced with the non-conductive layers made of prepreg material. Otherwise, the support PCB 340 may be another electrically functional component, such as a FR4 PCB.

As explained herein, the support PCB 340 is electrically coupled with the plurality of printhead modules. In the present embodiment, the support PCB 340 is electrically coupled with the module PCB 330 of the printhead module 200 by wire bonding. Specifically, as shown in FIG. 3, conductor pads 350 of the module PCB 330 may be electrically coupled with conductor pads 352 of the support PCB 340 with help of conductor wires 354. Once the plurality of printhead modules, such as the printhead module 300, is electrically coupled with the support PCB 340 the conductor wires, such as the conductor wires 354, may be encapsulated for insulation and protection from corrosive inks/printed materials. For example, the encapsulation of the conductor wires, such as the conductor wires 354, may be done with help of thermally curable adhesive, such as epoxides, acrylics, and urethanes or UV curable adhesives Further, the thermally curable adhesive may be one of a single-part or two-part thermally curable adhesive, or a room temperature curable two part adhesive or UV curable adhesive may be used to avoid the stress development due to thermal expansion mismatches between module and support frame materials. Moreover, the encapsulation of the conductor wires 354 may be performed by a dam and fill method.

The micro-fluid ejection head 30 of the present disclosure also includes a support frame 360. The support frame 360 is adapted to mount the support PCB 340 thereon. In the present embodiment, the support PCB 340 is mounted on the support frame 360 by a pressure sensitive adhesive. For example, a thin layer of pressure sensitive adhesive may be disposed between the support PCB 340 and the support frame 360, and thereafter pressure may be applied on the support PCB 340 and the support frame 360 for attachment thereof. In the present embodiment, the support frame 360 is made of a moldable non-conducting material. For example, the support frame 360 may be made of one of ceramic, plastic and glass. Additionally, the support frame 360 may be made of a low conducting metal covered with a layer of insulating material. Therefore, the support frame 360 of the present disclosure is adapted to provide only mechanical support to the support PCB 340.

As explained herein, the support PCB 340 further facilitates in providing the fluidic interface between the ejection chip 310 and the fluid source. Specifically, the support frame 360 may include a plurality of cutouts (not shown) confirming to the plurality of cutouts of the support PCB 340. In such instances, it is to be understood that, the layer of thermally curable adhesive, attaching the support PCB 340 and the support frame 360 may be configured (laser drilled or die cut) to have cutouts, conforming to the cutouts of the support PCB 340 and the support frame 360. Otherwise, the thermally curable adhesive may be dispensed in an amount and pattern such that adhesive layer facilitates cutout to cutout connection, without any blockage which may be caused by the adhesive layer. Further, the cutouts of the support PCB 340 and the support frame 360 are aligned with each other, for allowing the module base 320 of the printhead module 300 to be fluidically coupled with the fluid source with the help components, such as pipes, gaskets and adhesive seals. For example, the module base 320 is accessed through the aligned cutouts of the support PCB 340 and the support frame 360 for allowing components, such as tubing, a gasket or an adhesive seal, to fluidically couple the module base 320 with the fluid source. This provides the fluidic interface between the ejection chip 310 and the fluid source through the module base 320.

In use, the ejection chip 310 is adapted to receive the electrical power and serial data through the support PCB 340. Specifically, the support PCB 340 is connected to power and ground bus structures and serial data routing. Further, the conductor wires, such as the conductor wires 354, provide interconnections, such as serial data input/output and power/ground connections between the module PCB 330 and the support PCB 340. Therefore, based on the specific serial data and electrical power signals provided, some of the fluid firing elements of the plurality of fluid firing elements of the ejection chip 310 may be triggered for firing fluid, to be received on a media sheet.

In the present embodiment, the use of support PCB 340 (an electrically functional component) provides a large conductor cross sectional area which facilitates in handling high currents with minimal voltage drops. Further, the support PCB 340 provides inherent distributed capacitance from the power and ground planes, which helps in minimizing EMC concern and thereby improving signal integrity. Moreover, the support PCB 340 provide a possibility of mounting physical electrical components, such as capacitors, to provide local decoupling and fast response current sources, which maximizes performance of the micro-fluid ejection head 30.

Additionally, use of STABLCOR® PCB as the support PCB 340 provides a stiffer frame for a given thickness as compared against standard FR4 PCBs. Therefore, support PCB 340 is less likely to flex in response to mounting forces when plurality of printhead modules, such as the printhead module 300, is mounted on the support PCB 340. Further, the concern of fracture during shipping/handling may be reduced with the use of STABLCOR® PCB as the support PCB 340 versus some more fragile materials like ceramics. Moreover, a low CTE and high Tg STABLCOR® PCB facilitates the support PCB 340 to be conveniently mounted with the plurality of printhead modules, such as the printhead module 300, by a thermally curable adhesive, and the wire bonding (the conductor wires 354) to be encapsulated with the thermally curable adhesives.

Figure 4:
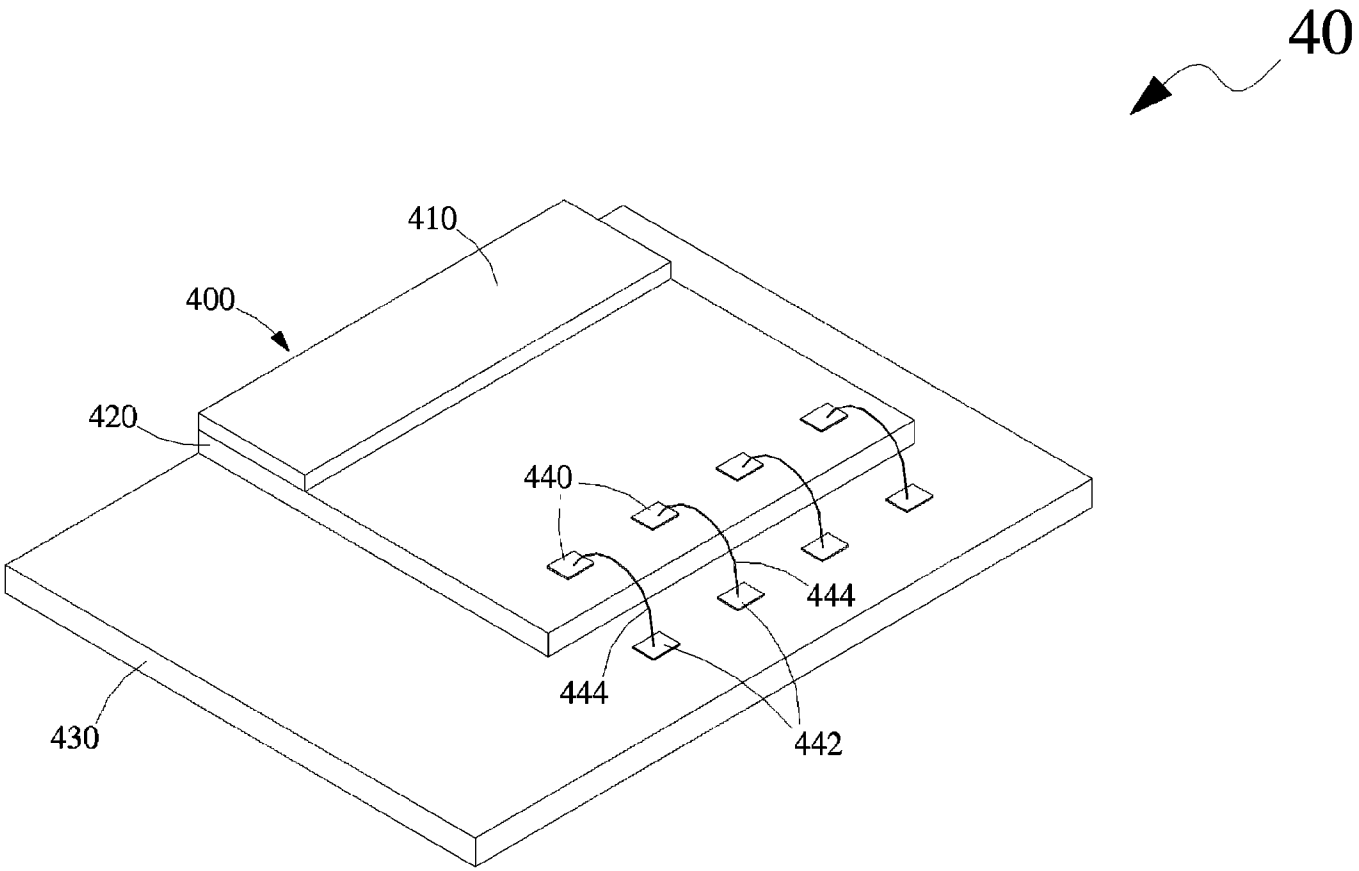

Referring now to FIG. 4, a schematic view of a portion of a micro-fluid ejection head 40 is depicted, according to yet another embodiment of the present disclosure. The micro-fluid ejection head 40 comprises a plurality of printhead modules, such as a printhead module 400. Each of the plurality of printhead modules includes an ejection chip. For example, the printhead module 400 includes an ejection chip 410. The ejection chip 410 of the printhead module 400 is structurally and functionally similar to the ejection chip 210 of the printhead module 200. Accordingly, the description of the ejection chip 410 of the printhead module 400 is avoided for the shake of brevity.

The printhead module 400 also includes a module base 420 adapted to carry the ejection chip 410 thereon. In the present embodiment, the ejection chip 410 is mounted on the module base 420 with the help of a thermally curable adhesive. For example, a thin layer of thermally curable adhesive, such as epoxides, acrylics, and a resin, may be disposed between the ejection chip 410 and the module base 420, and thereafter the adhesive layer is thermally cured for attaching the ejection chip 410 with the module base 420. The module base 420 is also fluidically coupled with the ejection chip 210. Specifically, the module base 420 may include a plurality of ports confirming to ports of a bottom layer (not shown) of the ejection chip 410. In such instances, it is to be understood that, the thermally curable adhesive may be dispensed in an amount and pattern such that adhesive layer facilitates fluidical coupling between the ejection chip 410 and the module base 420, without any blockage which may be caused by the adhesive layer.

In the present embodiment, the module base 420 is an electrically functional component. For example, the module base 420 is a printed circuit board (PCB). Specifically, the module base 420 includes a plurality of conductive layers (not shown) interspaced with a plurality of non-conductive layers (not shown). Further, the plurality of conducting layers may be composed of at least one of carbon fiber and copper, and the plurality of non-conductive layers may be composed of a prepreg material. Specifically, the conductive layers of carbon fiber may provide ground plane, whereas the conductive layers of copper may facilitate in passing electrical power and serial data. For example, the module base 420 may be a STABLCOR® PCB; particularly, the module base 420 may be a laminate construct having a plurality of conducting layers (wiring layer) made of carbon fiber and copper, interspaced with the non-conductive layers made of prepreg material. Alternatively, the module base 420 may be other electrically functional component, such as a FR4 PCB.

The module base 420 is further electrically coupled with the ejection chip 410. Specifically, the module base 420 is electrically coupled with the ejection chip 410 by wire bonding (not shown) for providing electrical power and serial data to the ejection chip 410. Therefore, based on the electrical power and serial data provided/input, some of fluid firing elements of a plurality of fluid firing elements of the ejection chip 410 may be triggered for firing fluid, to be received in a media sheet, which will be explained in greater detail herein later.

The micro-fluid ejection head 40 of the present embodiment also includes a support frame 430. The support frame 430 is adapted to mount the plurality of printhead modules, such as the printhead module 400, thereon. Further, the plurality of printhead modules, such as the printhead module 400, is mounted on the support frame 430 for configuring a lengthy array of the plurality of printhead modules, as explained above in conjunction with FIG. 2.

In the present embodiment, the support frame 430 includes a plurality of cutouts (not shown), such as cutouts 16 carried by the support frame 14. The cutouts of the support frame 430 are adapted to partially receive module bases of the plurality of printhead modules. For example, the module base 420 may be partially received by a cutout (not shown); thereafter the module base 420 may be attached with the support frame 430 using an adhesive. In the present embodiment, the module base 420 may be attached with the support frame 430 initially with tack and hold adhesive to fixture the module base 420 in place on the support frame 430, followed by a more structural adhesive. Specifically, the tack and hold adhesive is a radiation—UV curable acrylate adhesive while the structural adhesive is a two part room temperature cure epoxy. These two adhesives may be used for attaching the module base 420 with the support frame 430.

The cutouts of the support frame 430 further facilitate in providing the fluidic interface between the ejection chip 410 and a fluid source. In the present embodiment, the module base 420 of the printhead module 400 may be fluidically attached with the fluid source with the help components, such as pipes, gaskets and adhesive seals. For example, the module base 420 is accessed through the cutout of the support frame 430 for allowing the components, such as a tube, a gasket or an adhesive seal, to fluidically couple the module base 420 with the fluid source. This provides the fluidic interface between the ejection chip 410 and the fluid source through the module base 420.

In the present embodiment, the support frame 430 is an electrically functional component. For example, the support frame 430 is a printed circuit board (PCB).

Specifically, the support frame 430 includes a plurality of conductive layers (not shown) interspaced with a plurality of non-conductive layers (not shown). Further, the plurality of conducting layers may be composed of at least one of carbon fiber and copper, and the plurality of non-conductive layers may be composed of a prepreg material. For example, the support frame 430 may be a STABLCOR® PCB; particularly, the support frame 430 may be a laminate construct having a plurality of conducting layers (wiring layer) made of carbon fiber and copper, interspaced with the non-conductive layers made of prepreg material. Alternatively, the support frame 430 may be other electrically functional component, such as a FR4 PCB.

The support frame 430 is adapted to be electrically coupled with the plurality of printhead modules. Specifically, the support frame 430 is electrically coupled with the module base 420 of the printhead module 200 by wire bonding. As shown in FIG. 2, conductor pads 440 of the module base 420 may be electrically coupled with conductor pads 442 of the support frame 430 with help of conductor wires 444. Once the plurality of printhead modules, such as the printhead module 400, is electrically coupled with the support frame 430, the conductor wires 444 may be encapsulated for insulation and protection from corrosive inks/printed materials. For example, the encapsulation of the conductor wires may be performed with help of thermally curable adhesive, such as epoxides, acrylics, and urethanes or UV curable adhesives. Further, the thermally curable adhesive may be one of a single-part or two-part thermally curable adhesive, or a room temperature curable two part adhesive or UV curable adhesive may be used to avoid the stress development due to thermal expansion mismatches between module and support frame materials. Moreover, the encapsulation of the conductor wires 444 may be performed by a dam and fill method.

In use, the ejection chip 410 is adapted to receive the electrical power and serial data through the support frame 430. Specifically, the support frame 430 is further connected to power and ground bus structures and serial data routing for receiving a specific serial data and the electrical power. Further, the conductor wires, such as the conductor wires 444, provide interconnections, such as serial data input/output and power/ground connections between the module base 420 and the support frame 430. Therefore, based on the specific serial data and electrical power provided, some of the fluid firing elements of the plurality of fluid firing elements of the ejection chip 410 may be triggered for firing fluid, to be received on a media sheet.

In the present embodiment, the use of module base 420 (as an electrically functional component) eliminates a need of a separate module PCB, such as module PCBs 230 and 330 of the printhead modules 200 and 300, respectively. Further, the use of support frame 430 (as an electrically functional component) provides a large conductor cross sectional area which facilitate in handling high currents with minimal voltage drops. Furthermore, the support frame 430 provides inherent distributed capacitance from the power and ground planes, which helps in minimizing EMC concern and thereby improving signal integrity. Moreover, the support frame 430 provide a possibility of mounting physical electrical components, such as capacitors, to provide local decoupling and fast response current sources, which maximizes performance of the micro-fluid ejection head 40.

Additionally, use of STABLCOR® PCB as support frame 430 may provide a stiffer frame for a given thickness as compared against standard FR4 PCBs. Therefore, support frame 430 is less likely to flex in response to mounting forces when plurality of printhead modules, such as the printhead module 400, is mounted on the support frame 430. Further, the concern of fracture during shipping/handling may be reduced with the use of STABLCOR® PCB as the support frame 430 versus some more fragile materials like ceramics. Moreover, a low CTE and high Tg STABLCOR® PCB facilitates the support frame 430 to be conveniently mounted with the plurality of printhead modules by a thermally curable adhesive, and the wire bonding (the conductor wires 444) to be encapsulated with the thermally curable adhesives.

Figure 5:
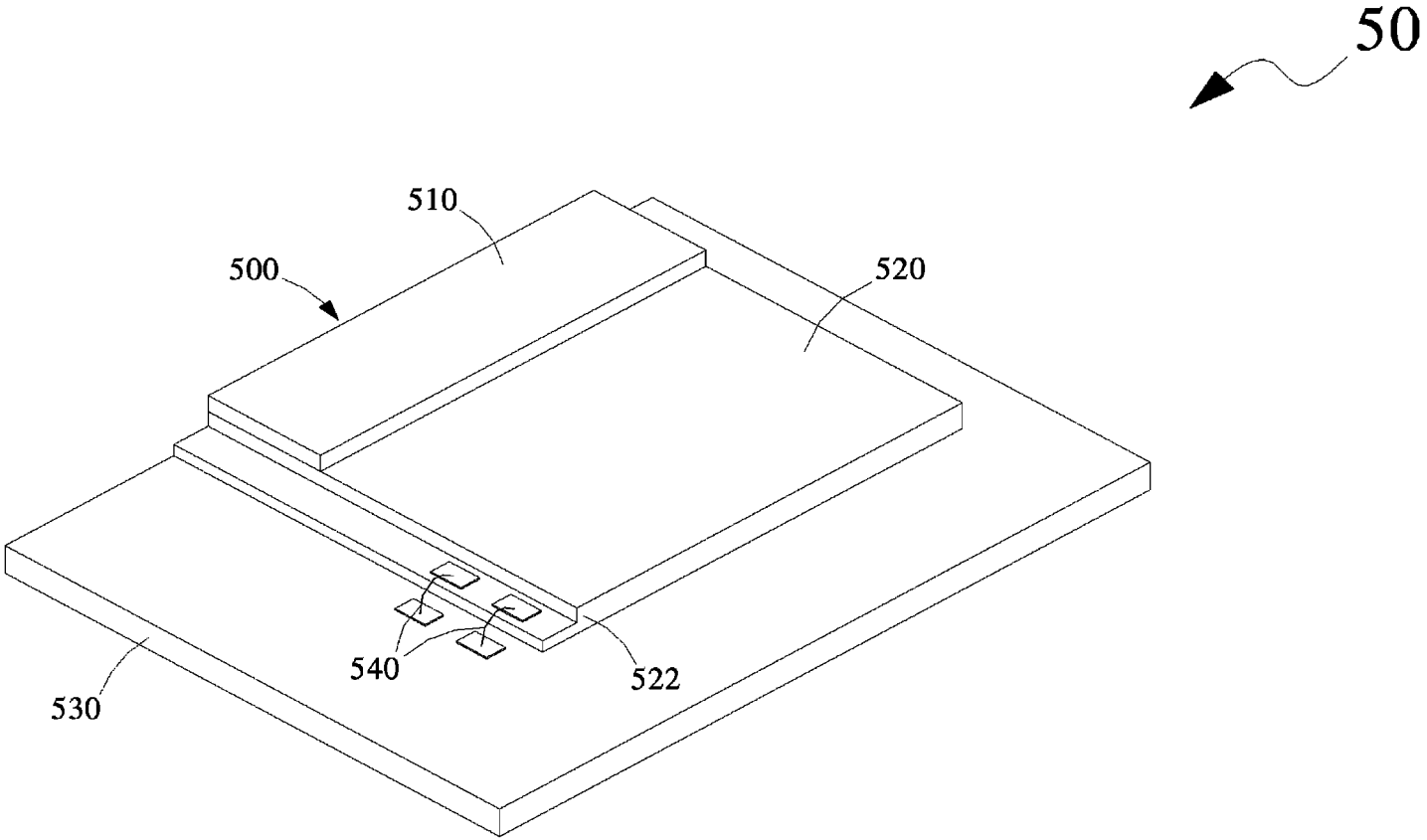

Referring now to FIG. 5, a schematic view of a portion of a micro-fluid ejection head 50 is depicted, according to still another embodiment of the present disclosure. The micro-fluid ejection head 50 of the present disclosure is substantially similar to the micro-fluid ejection head 40 (explained in conjunction with FIG. 4). For example, the micro-fluid ejection head 50 includes a plurality of printhead modules, such as a printhead module 500. Each of the plurality of printhead module includes an ejection chip. For example, the printhead module 500 includes an ejection chip 510. The ejection chip 510 is structurally and functionally similar to the ejection chip 410 of the printhead module 400 (shown in FIG. 4). Accordingly, description of the ejection chip 510 is avoided for the sake of brevity.

Each of the plurality of printhead module also includes a module base. For example, the printhead module 500 includes a module base 520. The module base 520 is adapted to be mounted with the ejection chip 510, in a similar manner in which the module base 420 is adapted to be mounted with the ejection chip 410, as explained in conjunction with FIG. 4.

Referring back to FIG. 5, the micro-fluid ejection head 50 also includes a support frame 530. The support frame 530 is adapted to mount the plurality of printhead modules, such as the printhead module 500, thereon. The support frame 530 of the micro-fluid ejection head 50 is similar to the support frame 430 of the micro-fluid ejection head 40. Accordingly, description of the support frame 530 is avoided for the sake of brevity.

In the present embodiment, the support frame 530 and the module base 520 of the printhead module 500 are electrically functional element, such as a STABLCOR® PCB or a FR4 PCB. Further, the module base 520 of the present disclosure is configured to have a stepped configuration. Specifically, as shown in FIG. 5, an edge portion 522 of the module base 520 is configured to have the stepped configuration. The stepped configuration of the module base 520 facilities in conveniently encapsulating wire bonding, i.e. the conductor wires 540, electrically coupling the module base 520 and the support frame 530. Specifically, stepped configuration reduces height of the conductor wires 540, thereby providing reliable encapsulation of the wire bonding, i.e. the conductor wires 540. Additionally, reduced height of the conductor wires 540 facilitates the encapsulating material to maintain a required gap between a media sheet and the plurality of printhead modules, such as the printhead module 500, carried by the support frame 530.

It may be evident to those skilled in the art that the micro-fluid ejection heads 20, 30, 40 (explained in conjunction with FIGS. 2-4, respectively) may also include similar structural configuration. Specifically, the module bases 220, 320 and 420 of the micro-fluid ejection heads 20, 30, 40 may be configured to have stepped configuration for providing reliable encapsulation of the wire bonding, used for electrical coupling. Additionally, when a module base, such as the module bases 220 and 320, is made of moldable non-conducting material, such as ceramic, plastic, glass or low conducting metal, the module base may be easily molded to have various shapes which facilitates in reducing a height the wire bonding, and thereby providing reliable encapsulation of the wire bonding.

Moreover, it may be evident to those skilled in the art that the micro-fluid ejection heads 20, 30, 40, 50 (explained in conjunction with FIGS. 2-5, respectively) may include additional electrical coupling. Specifically, the module PCBs 230, 330 and module bases 420, 520 of the micro-fluid ejection heads 20, 30, 40, 50 may be electrically coupled with ball bonding, conductive adhesives, or the like.

The present disclosure provides a micro-fluid ejection head, such as micro-fluid ejection heads 10-50, adapted to be used in conjunction with a printer. The micro-fluid ejection head avoids a need of a separate flex cable for receiving serial data and/or electrical power. Further, the micro-fluid ejection head of the present disclosure is adapted to provide better signal isolation and signal integrity for the serial data and/or electrical power. Additionally, the micro-fluid ejection head of the present disclosure includes enhanced mechanical and thermal properties. For example, the micro-fluid ejection head of the present disclosure is stiffer, therefore capable of bearing mounting forces during manufacturing and eliminates chances of fracture during shipping/handling. Further, the micro-fluid ejection head of the present disclosure may have a low CTE (coefficient of thermal expansion) and high Tg (Transition temperature) which enhances thermal properties of the micro-fluid ejection head.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A micro-fluid ejection head, comprising:

a plurality of printhead modules, each of the plurality of printhead modules comprising an ejection chip for ejecting fluid, and a module base to mount the ejection chip, the module base providing fluidic interface between the ejection chip and a fluid source; and a support frame to mount the module base of the plurality of printhead modules for creating a lengthy array of the plurality of printhead modules, wherein the support frame is electrically coupled with the module base of the plurality of printhead modules for allowing the plurality of printhead modules to receive data and electrical power, the support frame being a printed circuit board having a plurality of cutouts to partially receive and mount therein said each of the plurality of printhead modules, the printed circuit board having a top surface with conductor pads that wire bond with the module base.

2. The micro-fluid ejection head of claim 1, wherein the module base is a printed circuit board (PCB) having a plurality of conductive layers interspaced with a plurality of non-conductive layers.

3. The micro-fluid ejection head of claim 2, wherein each of the plurality of conducting layers is composed of at least one of carbon fiber and copper.

4. The micro-fluid ejection head of claim 2, wherein each of the plurality of non-conductive layers is composed of a prepreg material.

5. The micro-fluid ejection head of claim 1, wherein the printed circuit board (PCB) has a plurality of conductive layers interspaced with a plurality of non-conductive layers.

6. The micro-fluid ejection head of claim 5, wherein each of the plurality of conducting layers is composed of at least one of carbon fiber and copper.

7. The micro-fluid ejection head of claim 5, wherein each of the plurality of non-conductive layers is composed of a prepreg material.

8. The micro-fluid ejection head of claim 1, wherein the wire bond is encapsulated by a thermally curable adhesive.

9. The micro-fluid ejection head of claim 1, wherein the module base is configured to have a stepped configuration.

* * * * *